US006886865B2

(12) United States Patent
Jung

(10) Patent No.: US 6,886,865 B2
(45) Date of Patent: May 3, 2005

(54) LOCKING DEVICE FOR EXTENSION PIPE OF VACUUM CLEANER

(75) Inventor: Joo-Suck Jung, Gwangju (KR)

(73) Assignee: Samsung Gwangju Electronics Co., Ltd, Gwangju (KR)

( * ) Notice: Subject to any disclaimer, the term of this patent is extended or adjusted under 35 U.S.C. 154(b) by 0 days.

(21) Appl. No.: 10/645,151

(22) Filed: Aug. 21, 2003

(65) Prior Publication Data

US 2004/0124630 A1 Jul. 1, 2004

(30) Foreign Application Priority Data

Dec. 31, 2002 (KR) ..... 10-2002-0087918

(51) Int. Cl.[7] ..... F16L 27/08; A47L 9/24
(52) U.S. Cl. ..... 285/7; 285/320; 15/414
(58) Field of Search ..... 285/7, 305, 320, 285/303, 902; 15/314, 337, 414, 327.1, 377

(56) References Cited

U.S. PATENT DOCUMENTS

| | | | | | |
|---|---|---|---|---|---|
| 1,096,690 | A | * | 5/1914 | Derbyshire | 285/317 |
| 1,202,601 | A | * | 10/1916 | Snyder | 285/303 |
| 3,159,412 | A | * | 12/1964 | Descarries | 285/7 |
| 3,328,977 | A | * | 7/1967 | Wallis, Jr. | 73/527 |
| 3,393,703 | A | * | 7/1968 | Richardson et al. | 137/583 |
| 3,602,009 | A | * | 8/1971 | Powell | 464/52 |
| 4,555,131 | A | * | 11/1985 | Weinhold | 285/91 |
| 4,700,926 | A | * | 10/1987 | Hansen | 251/149.8 |
| 5,074,601 | A | * | 12/1991 | Spors et al. | 285/308 |
| 5,462,380 | A | * | 10/1995 | Peek et al. | 403/329 |
| 5,941,577 | A | * | 8/1999 | Musellec | 285/317 |
| 6,231,089 | B1 | * | 5/2001 | DeCler et al. | 285/308 |
| 6,354,635 | B1 | * | 3/2002 | Dyson et al. | 285/308 |

FOREIGN PATENT DOCUMENTS

| | | |
|---|---|---|
| DE | 28 39 635 | 4/1979 |
| DE | 29619422 | 4/1998 |
| EP | 1 252 854 | 10/2002 |

OTHER PUBLICATIONS

Preliminary Search Report dated Aug. 23, 2004 from corresponding French Patent Application 0313234 filed on Nov. 12, 2003.

* cited by examiner

*Primary Examiner*—Eric K. Nicholson
(74) *Attorney, Agent, or Firm*—Ohlandt, Greeley, Ruggiero & Perle LLP

(57) ABSTRACT

Disclosed is a locking device for extension pipe of a vacuum cleaner which can be easily operated, especially in separating the extension pipe supporting holder, and be compactly manufactured since the components do not require much space. The locking device according to the present invention comprises a holder connected to an operation handle and having a locking hole formed on one side to correspond to a fixing hole of the operation handle, and a locking/unlocking lever having a hook portion movable into and out of the locking hole, and a button portion formed opposite to the hook portion along the diameter, the locking/unlocking lever movable between a locked position and an unlocked position, a locked position in which the hook portion is inserted into the locking hole, and an unlocked position in which the hook portion is escaped out of the locking hole. The button portion is disposed such that a force for unlocking the combination is applied in the same direction as the holder separating direction. Additionally, The button portion and the hook portion are disposed opposite to the hinge pins along the length of the locking/unlocking lever. In addition, an elastic portion is formed on opposite locations of the locking/unlocking lever so as to secure the locking/unlocking lever in the locked position by an elastic contact with the outer circumference of the holder.

7 Claims, 3 Drawing Sheets

LOCKING DEVICE FOR EXTENSION PIPE OF VACUUM CLEANER

BACKGROUND

1. Field of the Invention

The present invention is related to a locking device for an extension pipe of vacuum cleaner.

2. Description of the Related Art

In general, a vacuum cleaner is, as shown in FIG. 1, is comprised of a main body 10 usually having main parts such as a vacuum generating device therein, an operation handle 12 having a flexible hose 11 to be connected to the main body 10, an extension pipe 13 to be connected to the operation handle 12, a suction brush 14 to be connected to an end of the extension pipe 13, and a locking device for an extension pipe 15 for movably supporting the operation handle 12 and the extension pipe 13.

As shown in FIG. 1, the locking device 15 comprises a suction brush 14 and assorted assistant brushes (not shown), for example, for cleaning of narrow spaces. The locking device 15 is able to secure and release the connection between the operation handle 12 and the extension pipe 13.

FIG. 2 is a sectional view of a conventional locking device for an extension pipe. As shown in FIG. 2, a conventional locking device for an extension pipe comprises a holder 30 being coupled with an operation handle 12 and a locking/unlocking lever 40 for securing and releasing the connection between the holder 30 of the operation handle 12.

The holder 30 is in shape of a hollow pipe, comprising a locking hole 31 corresponding to the fixing hole 12*a* of the operation handle 12, and a supporting portion 32 protruding at a predetermined distance from the locking hole 31. To the opposite end of the operation handle 12 of the holder 30, the extension pipe 13 is connected, as shown in FIG. 1.

The locking/unlocking lever 40 includes a button portion 42 which is integrally formed on one end of a lever body 41 enclosing the holder 30, and at a predetermined space between the button portion 42 and the holder 30. Further, inside the other end of the lever body 41 is formed a hook portion 43 movable in and out through the locking hole 31 of the holder 30. A projection 44 is formed being supported by the supporting portion 32, between the hook portion 43 and the button portion 42.

In a conventional locking device for an extension pipe constructed as above, the locking/unlocking lever 40 turns up and down like a seesaw on the projection 44, accordingly the hook portion 43 of the holder 30 secures and releases the holder 30 with respect to the operation handle 12, moving in and out through the locking hole 31 of the holder 30.

Initially, that is, before an external force is applied to the button portion 42, the locking/unlocking lever 40 is in a status that the hook portion 43 is inserted in the locking hole 31 of the holder 30, as shown in FIG. 2, due to its recovery force of the lever body 41. Here, the hook portion 43 is also inserted into the fixing hole 12*a* of the operation handle 12 through the locking hole 31, and thus the holder 30 is secured in place.

On the other hand, when a pressing external force is applied to the button portion 42, the locking/unlocking lever 40 moves clockwise in FIG. 2 about the projection 44. Thus, the hook portion 43 becomes unlocked from the locking hole 31. At this time, the holder 30 can be separated from the operation handle 12 by drawing the holder 30 in a direction A in FIG. 2.

If an external force is removed from the button portion 42 after separating the holder 30, the locking/unlocking lever 40 now moves counterclockwise about the projection 44 of the lever body 41 due to its recovery force, so that the lever body 41 is returned to the initial position.

Further, if the holder 30 is again fit in with the operation handle 12 in a direction B in FIG. 2, the hook portion 43 is temporarily out of the locking hole 31, and is inserted into the fixing hole 12*a* of the operation handle 12 through the locking hole 31 when the locking hole 31 and the fixing hole 12*a* meet as the holder is sliding. Therefore, the holder 30 is secured in place.

However, in the above conventional locking device of a vacuum cleaner, because the projection 44 is placed between the button portion 42 and the hook portion 43, and especially because the button portion 42 of the locking/unlocking lever 40 is positioned opposite to the holder separating direction (direction A in FIG. 2), much force is required to press the button portion 42, and further, it becomes relatively harder to separate the holder 30.

Another problem of a conventional locking device 15 is that the locking/unlocking lever 40 needs to be large enough for the lever system in which the locking/unlocking lever 40 turns on the projection 44 upward and downward in a seesaw-like motion to lock or unlock the holder 30, so that it cannot be made compact.

SUMMARY

An object of the invention is to overcome at least the above problems and/or disadvantages of the related art by providing a locking device for an extension pipe of a vacuum cleaner, which is handy to use in separating a holder, and which can be in a compact size.

A locking device for an extension pipe according to the preferred embodiment of the present invention to achieve the above object comprises a holder connected to an operation handle and having a locking hole formed on one side to correspond to a fixing hole of the operation handle, and a locking/unlocking lever having a hook portion movable into and out of the locking hole, and a button portion formed opposite to the hook portion along the diameter, the locking/unlocking lever movable between a locked position and an unlocked position, a locked position in which the hook portion is inserted into the locking hole, and an unlocked position in which the hook portion is escaped out of the locking hole.

According to a preferred embodiment, the button portion is disposed such that a force for unlocking the combination is applied in the same direction as the holder separating direction.

The button portion and the hook portion are disposed opposite to the hinge pins of the locking/unlocking lever.

In addition, an elastic portion is formed on opposite locations of the locking/unlocking lever so as to secure the locking/unlocking lever in the locked position by an elastic contact with the outer circumference of the holder.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENT

Hereinafter, a preferred embodiment of a locking device for an extension pipe will be described in great detail with reference to the accompanying drawing.

Figure 1:
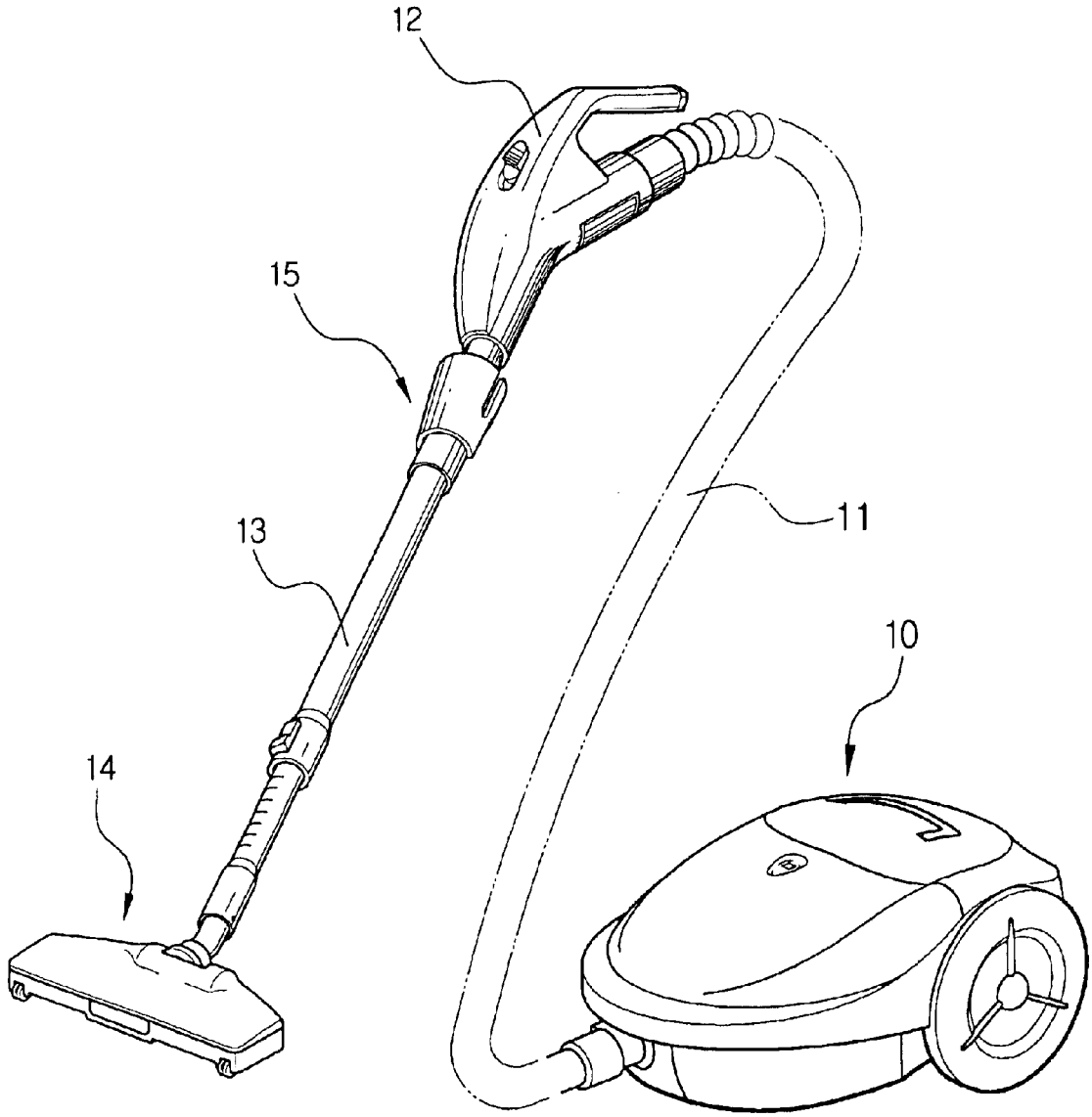
FIG. 1 (PRIOR ART)
FIG. 1 is a perspective view of a general vacuum cleaner.
Figure 2:
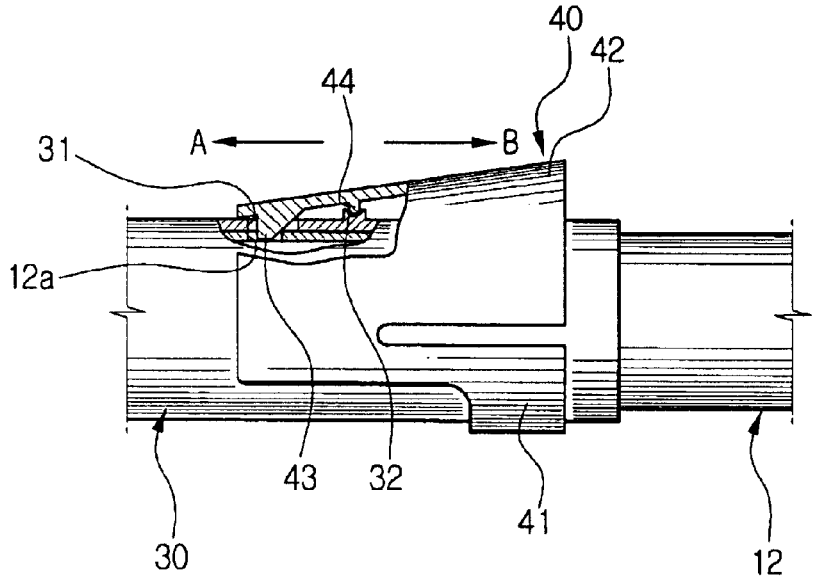
FIG. 2 (PRIOR ART)
FIG. 2 is a partial section of a locking device for an extension pipe of a conventional vacuum cleaner.
Figure 3:
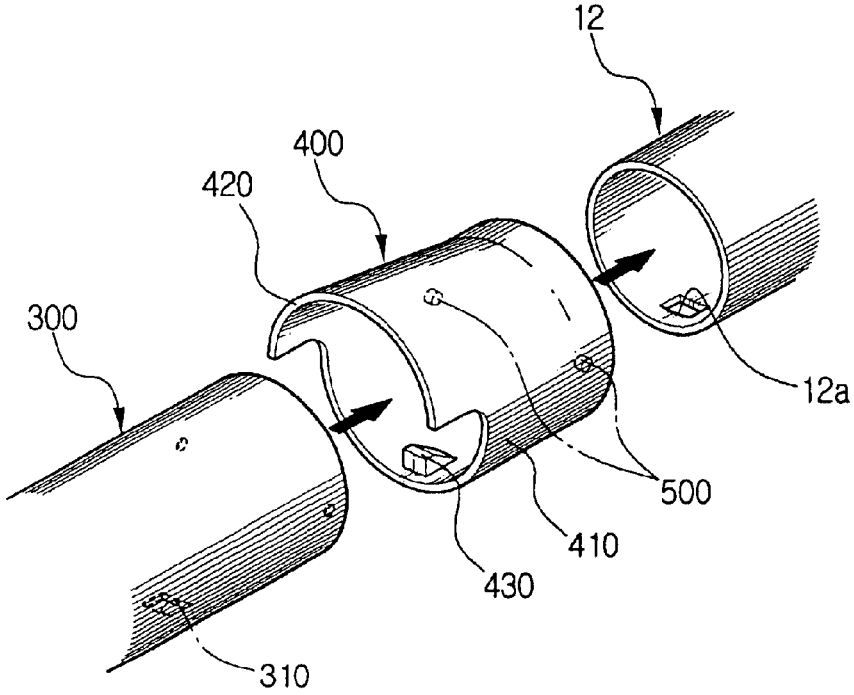
FIG. 3 is an exploded perspective of a locking device for an extension pipe of a vacuum cleaner according to an embodiment of the present invention.
Figure 4:
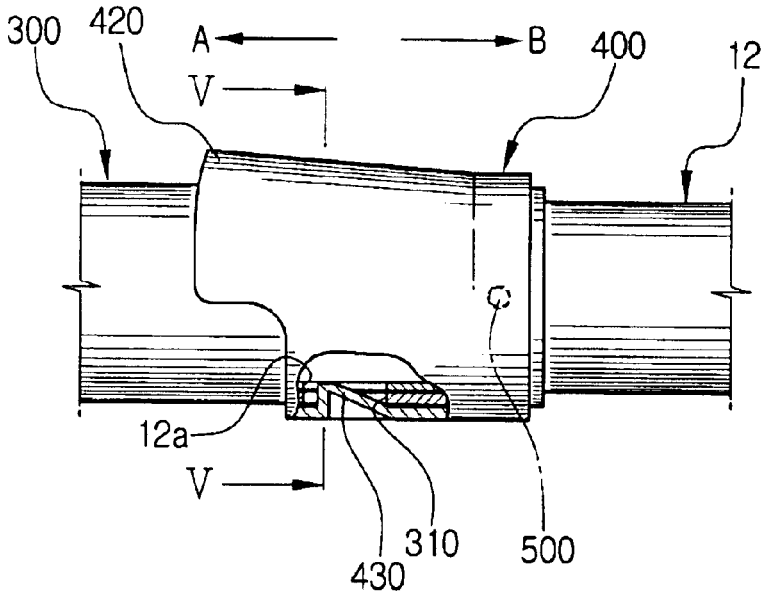
FIG. 4 is an assembly drawing of FIG. 3.
Figure 5:
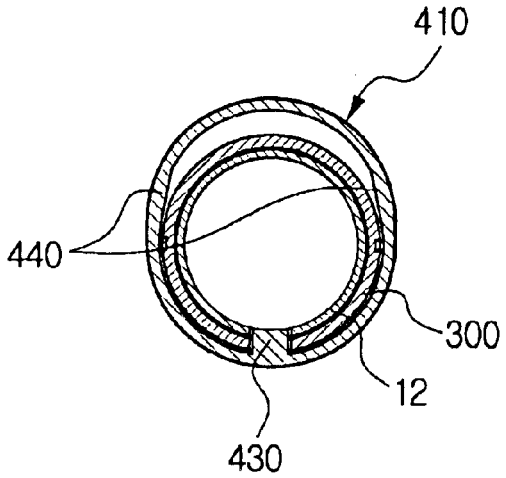
FIG. 5 is a sectional view of FIG. 4 cut along V—V line.

A locking device for an extension pipe according to the present invention comprises as shown in FIG. 3 through FIG. 5, a holder 300 to be combined with an operation handle 12, and a locking/unlocking lever 400 for securing and releasing the connection between the holder 300 and the operation handle 12.

The holder 300 is in shape of a hollow pipe, and comprises a locking hole 310 corresponding to the fixing hole 12*a* of the operation handle 12. Opposite to an end of the holder 300 which is connected with the operation handle 12, an extension pipe (now shown) is connected with the holder 300.

The locking/unlocking lever 400 includes a button portion 420 which is integrally formed on one end of a lever body 410 enclosing the holder 300, and at a predetermined space from the holder 300. Further, opposite to the button portion 420 along the diameter of the lever body 410 is formed a hook portion 430 movable into and out of the holder 300 through the locking hole 310. The button portion 420 and the hook portion 430 are oppositely disposed on the lever body 410. Additionally, the locking/unlocking lever 400 is mounted to move between a locked position and an unlocked position, a locked position in which a hook portion 430 is inserted into the locking hole 310 by hinge pins 500, and an unlocked position in which the hook portion 430 is escaped out of the locking hole 310. The hinge pins 500 are disposed opposite to the button portion 420 and the hook portion 430 along the length, and more in particular, the button portion 420 is disposed in the same direction as the holder separating direction (direction A in FIG. 4). In addition, on both sidewalls in the lever body 410, elastic portions 440 are formed so that the locking/unlocking lever 400 maintains a locked position in which the hook portion 430 is inserted into the locking hole 310 of the holder 300.

In such a manner, the locking device for an extension pipe according to the present invention secures and releases the connection between the holder 300 and the operation handle 12, by the locking/unlocking lever 400 rotating about the hinge pins 500 and its hook portion 430 inserted in and escaped out of the locking hole 310 of the holder 300.

Initially, that is, before an external force is applied to the button portion 420, the locking/unlocking lever 400 is in a status that the hook portion 430 is inserted in the locking hole 310 of the holder 300, as shown in FIG. 4, due to the elastic portion 440 formed inside the lever body 41. Here, the hook portion 430 is also inserted into the fixing hole 12*a* of the operation handle 12 through the locking hole 310, and thus the holder 300 is secured in place.

On the other hand, when a pressing external force is applied to the button portion 420, the locking/unlocking lever 400 moves counterclockwise about the hinge pins 500. Thus, the hook portion 430 becomes unhooked from the locking hole 310. At this time, the holder 300 can be separated from the operation handle 12 by drawing the holder 300 in a direction A in FIG. 4. Here, it becomes easier to separate the holder 300 since the button portion 420 and the hook portion 430 are disposed on the opposite end to the hinge pins 500, and since the button portion 420 is disposed in the same direction as the holder separating direction.

If an external force is removed from the button portion 420 after separating the holder 300, the locking/unlocking lever 400 now moves clockwise about the hinge pins 500 due to the elastic portion 440 in the lever body 410, that is, the lever body 410 is returned to the locked position with its hook portion 430 inserted into the locking hole 310 of the holder 300.

Further, if the holder 300 is again fit in the operation handle 12 in a direction B in FIG. 4, the hook portion 430 is temporarily out of the locking hole 310, and is inserted into the fixing hole 12*a* of the operation handle 12 through the locking hole 310 when the locking hole 310 and the fixing hole 12*a* meet as the holder is sliding. Therefore, the holder 300 is secured in place.

According to the above embodiment of a locking device for an extension pipe, a button portion 420 and a hook portion 430 move up and down with hinge pins 500 disposed on the opposite end. Further, the button portion 420 is disposed toward the holder separating direction. Accordingly, it becomes handier to separate the holder 300 and use the vacuum cleaner.

Additionally, by adopting the above rotating-on-hinge pins system instead of the lever system of the conventional art, the locking device for an extension pipe can be operated easily and be in a compact size compared to the conventional one since the component parts of the locking/unlocking lever 400 do not take up much space.

Thereby, a more satisfactory and competitive vacuum cleaner can be provided.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A locking device for an extension pipe for removably connecting the extension pipe to an operation handle, comprising:

a holder connected to the operation handle, and having a locking hole formed on one side, to correspond to a fixing hole formed on the operation handle; and a locking/unlocking lever having a hook portion movable into and out of the locking hole, a button portion formed opposite to the hook portion along a diameter, and a hinge pin pivotally connected to the holder and disposed opposite to the button and hook portions along a length of the locking/unlocking lever, wherein the locking/unlocking lever is movable between a locked position and an unlocked position, wherein in the locked position the hook portion is in the locking hole, and wherein in the unlocked position the hook portion is out of the locking hole.

2. The locking device of claim 1, wherein the locking/unlocking lever has an open end, wherein the hinge pin is disposed in proximity to the open end, and wherein the operation handle can be inserted into the open end.

3. The locking device of claim 1, wherein the hinge pins is two hinge pins disposed on opposing sides of the locking/unlocking lever.

4. The locking device of claim 1, wherein an elastic portion is formed on opposite locations of the locking/ unlocking lever so as to secure the locking/unlocking lever in the locked position by an elastic contact with an outer circumference of the holder.

5. A vacuum cleaner comprising:

a vacuum source;

an operation handle having a fixing hole formed on one side and being connected to the vacuum source;

an extension pipe;

a holder having a locking hole formed on one side to correspond to the fixing hole, the holder being connected to the extension pipe; and a locking/unlocking lever having a hook portion and a button portion formed opposite to the hook portion along a diameter thereof, the locking/unlocking lever for removably connecting the holder to the operation handle, wherein the locking/unlocking lever is movable between a locked position and an unlocked position, wherein in the locked position the hook portion is inserted into the locking and fixing holes, and wherein in the unlocked position the hook portion is removed from the locking and fixing holes, wherein the locking/unlocking lever has hinge pins that pivotally connect the locking/unlocking lever with the holder, and wherein the button hook portions are disposed opposite to the hinge pins along a length of the locking/unlocking lever.

6. The vacuum cleaner of claim 5, wherein an elastic portion is formed on opposite locations of the locking/unlocking lever so as to secure the locking/unlocking lever in the locked position by an elastic contact with an outer circumference of the holder.

7. The vacuum cleaner of claim 5, wherein the locking/unlocking lever has an open end, wherein the hinge pins are disposed in proximity to the open end, and wherein the operation handle can be inserted into the open end.

* * * * *